United States Patent [19]

Grosman

[11] Patent Number: 4,867,609

[45] Date of Patent: Sep. 19, 1989

[54] ERECTION OF STRUCTURES ON UNEVEN FOUNDATION SITES

[76] Inventor: Isaac Grosman, Junin 1057, p. 7, Dpto. B, (1113) Buenos Aires, Argentina

[21] Appl. No.: 126,365

[22] Filed: Nov. 30, 1987

[30] Foreign Application Priority Data

Nov. 13, 1987 [AR] Argentina ..... 309,291

[51] Int. Cl.[4] ..... E02D 29/00

[52] U.S. Cl. ..... 405/195; 29/421.2; 403/277; 405/204; 405/251

[58] Field of Search ..... 405/195, 204, 227, 251; 29/421 E; 403/277, 284

[56] References Cited

U.S. PATENT DOCUMENTS

| | | | |
|---|---|---|---|
| 2,736,172 | 2/1956 | McChesney | 405/227 |
| 3,555,831 | 1/1971 | Pogonowski | 403/277 X |
| 3,593,530 | 7/1971 | Pogonowski | 405/195 |
| 3,661,004 | 5/1972 | Lee et al. | 29/421 E |
| 3,672,177 | 6/1972 | Manning | 405/227 |
| 4,117,966 | 10/1978 | Green et al. | 29/421 E |
| 4,319,393 | 3/1982 | Pogonowski | 29/523 |
| 4,449,280 | 5/1984 | Schroeder | 29/421 E |
| 4,593,448 | 6/1986 | Ferrari Aggradi et al. | 29/523 |
| 4,648,626 | 3/1987 | Vinciguerra et al. | 29/523 X |
| 4,687,062 | 8/1987 | Beghetto et al. | 405/227 X |

*Primary Examiner*—Dennis L. Taylor

*Attorney, Agent, or Firm*—Frishauf, Holtz, Goodman & Woodward

[57] ABSTRACT

Structures with inter-connecting members such as shores, struts, braces and the like which are subject to compression and/or tension stresses can be erected even when the foundation strata do not exactly meet anticipated levels, or when differential settlements occur at base points after loads are applied. At least one of the structural members is in the form of a first elongate section having a hollow mating end, and a second elongate section including a hollow bell-shaped end. The mating end of the first section is slidably received in the bell-shaped end of the second section, and the first and second sections are allowed to slide axially of one another at least during erection of the structure. At a desired time after erection, relative sliding movement between the first and second sections is prevented, thus fixing the length of the structural member.

19 Claims, 4 Drawing Sheets

ERECTION OF STRUCTURES ON UNEVEN FOUNDATION SITES

BACKGROUND OF THE INVENTION

1. Field of the Invention

The present invention relates generally to arrangements for erecting structures on uneven sites such as an ocean floor, and more particularly to an arrangement in which at least one structural member is formed by two elongate sections axially slidable relative to one another, and wherein the sliding movement is prevented at a desired time after erection of the structure so as to fix the length of the structural member.

2. Description of the Known Art

When erecting construction-related structures at places of difficult access, like the ocean floor or on mountainous ground, it is frequently found that the actual levels of different bases for the structure do not coincide with those initially assumed. Such inaccuracies sometimes occur due to difficulty in determining the exact morphology of the bearing strata. Differential settlements of distinct foundations once test loads are applied on different columns, also account for discrepancies between the assumed and the actual base levels.

In such cases it is necessary to underpin some bases, in order to keep all the bases at the levels assumed in the initial structural design. But underpinning is very difficult or impossible to accomplish in sites having difficult access. The only solution is to modify the length of some members of the structure, in order to overcome differences between the assumed and the actual structural configuration.

FIG. 1 represents an elemental structure formed by three rigid columns 1, 2 and 3, inter-connected by bracings 8 and 9, and rigidity diagonals 4, 5, 6 and 7.

FIG. 2 shows a condition in which an actual foundation plane for column 2 is at a lower level than the foundation plane for the bases of columns 1 and 3. As shown, the structure will tend to deform, and the members 4, 5, 6, 7, 8 and 9 will adopt the positions at *4a*, *5a*, *6a*, *7a*, *8a* & *9a*. Thus, if the base for column 2 cannot be underpinned, the members *4a*, *6a*, *8a* and *9a* must be lengthened while the members *5a* and *6a* must be shortened, as shown in solid lines in FIG. 2, in order to maintain the columns 1, 2 and 3 in a vertical position.

It will be understood that if the lengths of the mentioned members are not modified in FIG. 2, tension or compression stresses will arise. Such stresses, alone or combined with the regular loads that the members must withstand according to the initial design, can surpass the limits allowed and, eventually, lead to the destruction of some of the structural elements. It is mandatory, in such cases, to modify the lengths of almost all the connecting elements to meet the exact dimensions required by the actual structural configuration, thus avoiding abnormal stresses that may be provoked in different structural members by deformation of the construction.

To readjust all connecting members at an exact final length, delicate and troublesome operations would be necessary, using special clevises, turnbuckles, right-hand and left-hand thread bolts, sleeve nuts, slicing clamp plates and the like. Under certain conditions, as when the foundation is on an ocean bed in deep waters, such length-adjusting operations would be impossible to accomplish. When possible, these operations are nonetheless time-consuming and very costly, sometimes requiring the use of divers and special equipment. Bad oceanographic or atmospheric conditions make these difficulties grow worse. Storms, high waves, currents, very low temperature waters, heavy winds, rain, and very cold or hot atmospheric conditions can make it completely impossible to implement correcting operations for the lengths of structural members, making it necessary to suspend all work.

SUMMARY OF THE INVENTION

An object of the invention is to overcome the above and other shortcomings in the erection of structures on uneven foundation sites.

Another object of the invention is to provide a technique for modifying the length of a structural member in an environment having difficult access such as a sea bed, airplane fuselages and interior structures of missiles.

Another object of the invention is to provide a method for adjusting the length of different members of a given structure, which method can be performed in a relatively inexpensive manner precisely at the time when needed from a remote central location.

A further object of the invention is to enable adjustment in the length of different members of a given structure from a remote location such as a central console, such that when all the members reach an exact dimension required by the real structure, the lengths of the members can be fixed without subsequent abnormal stresses that would otherwise impair the anticipated behavior of the members in the structure.

An additional object of the invention is to allow an erected structure to be corrected and stabilized in a most perfect configuration, regardless of oceanographic or atmospheric conditions prevalent at a construction site.

A further object of the invention is to allow pre-tension or pre-compression stresses to be imparted to structural members requiring such prestresses in order to obtain better rigidity and/or stability of the structure.

A further object of the invention is to provide a method for fixing the length of a fuselage structure member in an airplane or missile, or any other machine or structure, when it is difficult or impossible for a worker to access the member, or when an adequate tool cannot be introduced readily to adjust the length of the member.

DETAILED DESCRIPTION OF THE INVENTION

Figure 3:
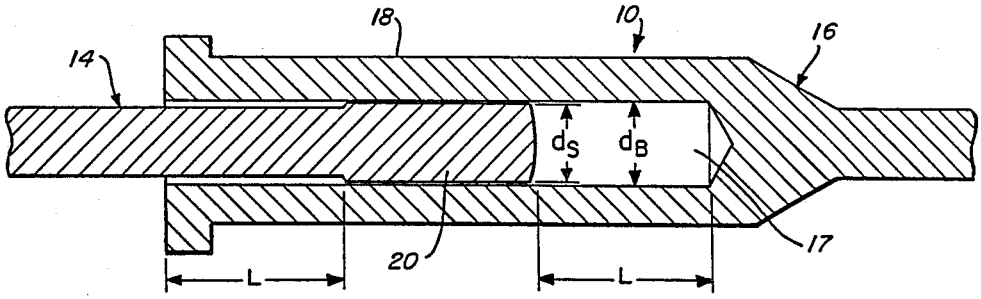
FIG. 3 is a schematic representation of an operating principle of a structural member according to the invention.

FIG. 3 shows an operating principle of the present invention. A structural member 10 whose length is adjustable at least during the erection of an associated structure, is formed of a first elongate section 14 and a second elongate section 16 adapted to be axially joined to one another. The second section 16 includes a hollow generally bell-shaped end 18 for slidably receiving a mating end 20 of the first section 14 in space 17. With a common longitudinal axis, the first and the second sections 14, 16 resemble a so-called "bell-and-spigot" joint. Upon application of a small axial force to one of the sections, the "spigot" at the end of the first section 14 can penetrate or separate with respect to the "bell" at the end of the second section 16 by a distance L. The distance L should be somewhat longer than the expected adjustment range to be given to the structural member 10, in view of the irregularities of a foundation floor, or an anticipated differential settlement for the bases of the assembled structure.

Figure 4:
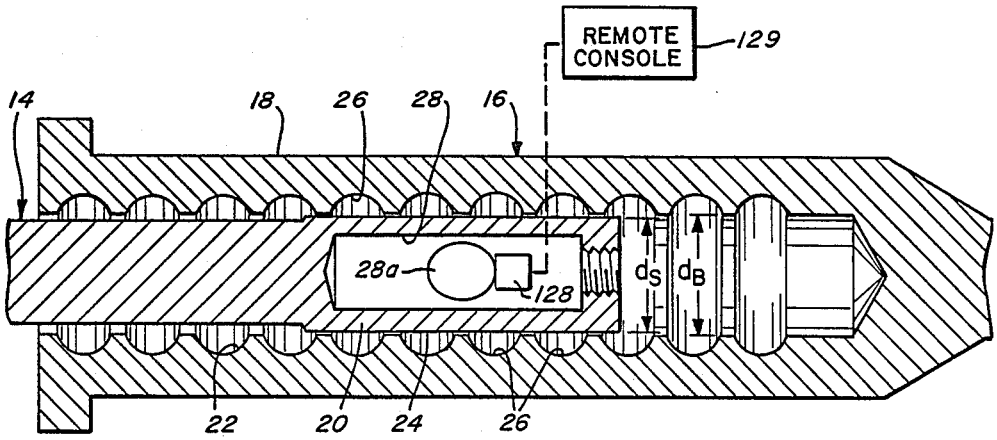
FIG. 4 is a cross-sectional view of a structural member according to a first embodiment of the invention.

FIG. 4 is an axial cross-sectional view of the sections 14, 16 in a first embodiment of the invention. Both sections 14, 16 may be cylindrical in form with circular cross-sections in the radial direction. The diameter dS of the first section 14 is slightly smaller than the diameter dB of the interior of the bell-shaped end 18 of the section 16. Thus, a certain clearance space is allowed between the opposing surfaces of the sections 14, 16 to allow for relative sliding axial movement. It is, of course, possible to select other than circular cross-sections for the first and second member sections 14, 16 and still provide for the relative sliding movement.

The inner periphery 22 of bell-shaped end 18 has an axial cross-section as shown in FIG. 4 so that, when the outer periphery 24 of the mating end 20 of first elongate section 14 faces the inner periphery 22, one or more hollow chambers or clearance spaces 26 are defined about the outer periphery 24 of mating end 20.

Figure 5:
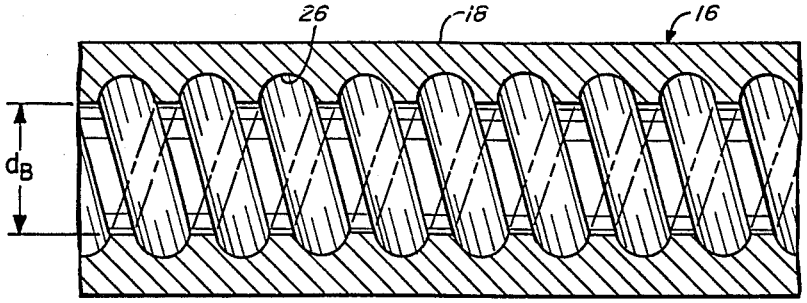
FIG. 5 is a sectional view of a second embodiment of the invention.

The clearance space or spaces 26 may be in the form of a series of toroidal cavities as shown in the first embodiment of FIG. 4. FIG. 5 shows a clearance space 26 in a second embodiment, wherein the space 26 is of helicoidal shape (i.e., like the thread of a bolt) with a pitch long enough to produce a relatively large space or chamber when opposed to the outer periphery 24 of the first section mating end 20 (not shown in FIG. 5).

Figure 6:
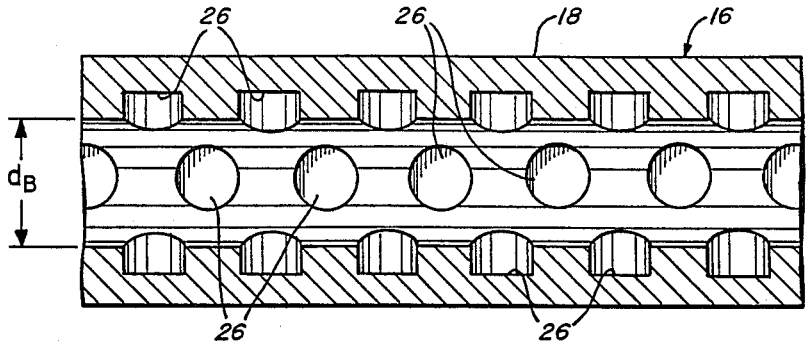
FIG. 6 is a sectional view of a third embodiment of the invention.
Figure 7:
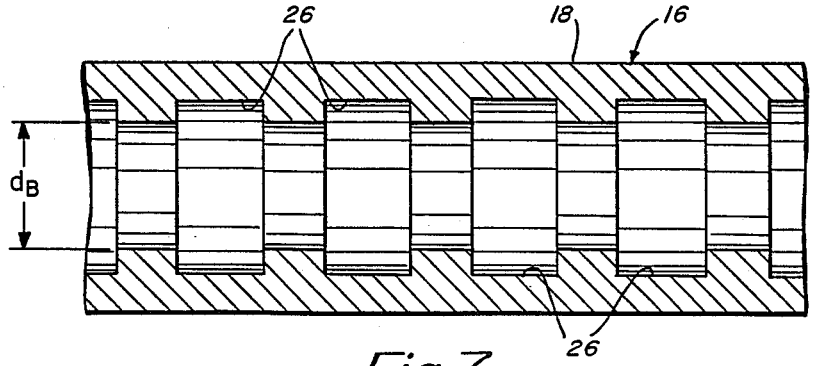
FIG. 7 is a sectional view of a fourth embodiment of the invention.

FIG. 6 shows a third embodiment in which a series of clearance spaces 26 are in the form of cylindrical cavities with their axes perpendicular to the axis of the second elongate section 16. A fourth embodiment, shown in FIG. 7, has the clearance spaces 26 in the form of a series of cylindrical cavities with their axes coincident with the axis of the second section 16.

The selection of the form, depth and distribution of the cavities or clearance spaces 26 will depend on the facilities of fabrication, and the relative efficiency of the various forms once tests are made for different structures to which the present invention applies. In any case, differences in form, depth and distribution of the various illustrated cavities or spaces 26 will not depart from the concept of the present invention.

Erection of structures according to the invention can be carried out, generally, following three successive steps.

Figure 1:
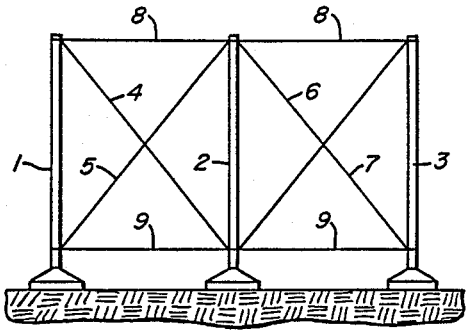
Fig. 1 (PRIOR ART)
FIG. 1 represents a design of a conventional basic structure to be erected on a foundation with an assumed uniform plane.
Figure 2:
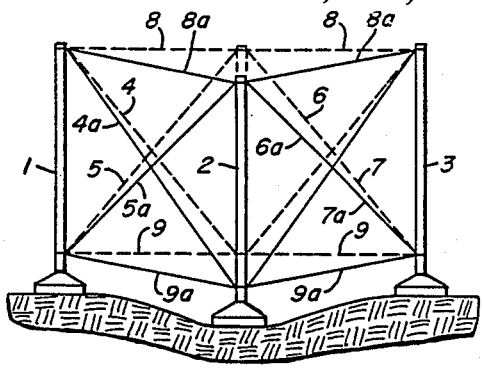
Fig. 2 (PRIOR ART)
FIG. 2 represents the structure of FIG. 1 when erected on a foundation with a non-uniform plane.

During a first step, a structure such as the one depicted in FIG. 1 is erected, but with the use of at least one structural member such as the member 10 of the present invention. Since the member or members 10 do not, at this step, have capacity to absorb compression or tension forces, the stability of the structural section being erected is obtained temporarily with guys, provisory braces, winches, tugs, bull dosers, and the like, depending on the type and location of the construction.

Since both the first and the second elongate sections 14, 16 of each structural member 10 can slide easily relative to one another, any difference in the level of the foundation bases will be corrected automatically without increase of any compression or tension stresses. Each member 10 then will reach the exact length needed for the structure and, thus, adapt exactly to the actual configuration of the foundation strata. When part of the entire structure has been plumbed exactly, and angles and general measures coincide with those of the project, then the second step follows.

In the second step, once the vertical members or columns are perfectly plumbed, the apparatus has settled in the sea bed, and the angles of the different elements coincide with those of design plans, an expansive pressure of a kind to be described is applied suddenly to each of the structural members 10 either successively, or simultaneously to a set of the members 10 or the whole structure.

The mentioned expansive pressure or force is generated in an interior chamber 28 in the mating end 20 of the first elongate section 14. At those regions where the exterior surface of the mating end 20 closely coincide with the interior surface of the bell-shaped end 18 of the second elongate section 16, the combined rigidity of the walls of both sections 14, 16 will absorb the expansion pressure developed in the interior chamber 28. At regions where there is no close contact between both wall surfaces, however, i.e., at the clearance spaces 26, the walls of the mating end 20 are adapted to deform inelastically in response to the expansive pressure, until contacting with the radial boundaries of the clearance spaces 26. Importantly, the deformation of the wall surrounding the interior chamber 28 is calculated to exceed the elastic range of the material forming the first section 14, and to obtain a strain that will force the material to enter the inelastic or plastic range. That is, the material will never regain its original shape once the strain passes. A permanent deformation or dialation will remain in the first section 14 once the expanding pressure diminishes, in correspondence with the clearance space or spaces 26 facing the mating end 20 during application of the expansive pressure. The diameter dS of the mating end 20 will increase accordingly. Further, the wall of the bell-shaped end 18 is adapted so that no strains are produced that could exceed its elastic stress. That is, once the expansive pressure diminishes, the inner diameter of the bell-shaped end 18 remains at dB, while the deformaties or protuberances that remain permanently on the exterior of the mating end 20 will prevent sliding movement between the first and the second elongate sections 14, 16.

Accordingly, the first and the second elongate sections 14, 16 become joined to one another to form a rigid structural member of fixed length, and with capacity to absorb tension or compression forces according to the design parameters of a given project. As a result of the foregoing operation, there is provided a structural member of an exact length required by an actual structural configuration, with no abnormal stresses and able to behave as a sole and unique member with the ability to absorb those normal stresses anticipated by the static design of the structure.

It should be noted that prior to the mentioned first step, oil or grease may be used in order to facilitate reciprocal movements of the first and the second sections 14, 16. After the mentioned second step including the application of a high pressure in the interior chamber 28, the high pressure and accompanying temperature elevation will damage the oil or grease by carbonizing it or, at least, making the substances lose their lubricant qualities. In this case, the lubricants then contribute to fix both the sections 14, 16 more solidly, and help the newly formed structural member to absorb the compression or tensile forces anticipated.

Figure 8:
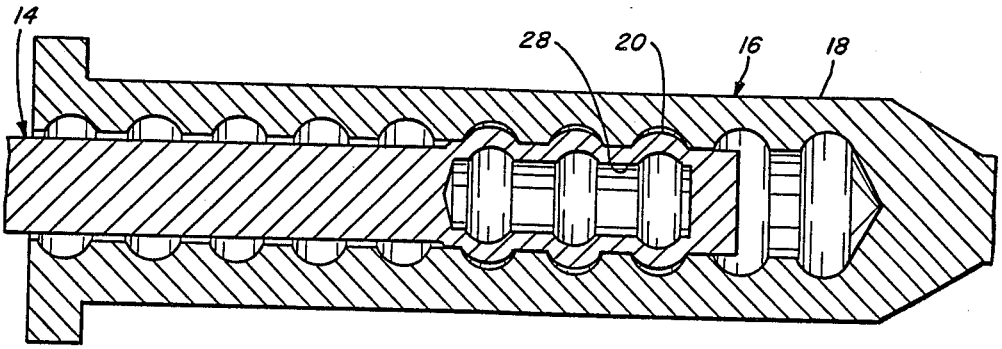
FIG. 8 is a sectional view of the first embodiment, showing expansion of a first section within a second section of the present structural member.

FIG. 8 represents the physical condition of the joined sections 14, 16 at the end of the second step.

Once the expansion operation is extended to the whole structure, and the high pressure is removed and the temperature of the formed structural members settles at the general level of the remainder of the construction, a third step ensues.

The third step includes removing all provisory means (guys, turn-buckles, etc.) employed to maintain the structure perfectly plumbed and aligned. Since the inter-connecting members are now fixed at their final lengths, the structure stays plumbed and aligned. All the structural members are fitted to accomplish their functions as anticipated in the project, without abnormal stresses.

Figure 10:
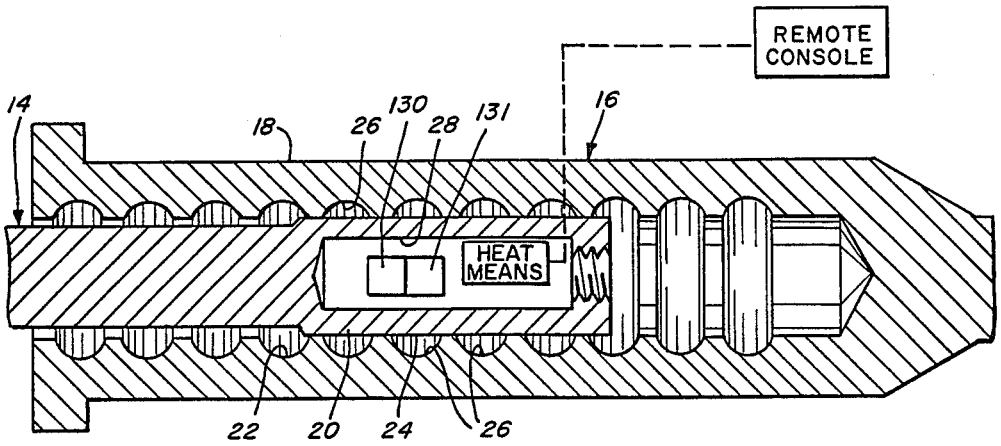
FIGS. 10 and 11 show respective means for applying an expansion force.
Figure 11:
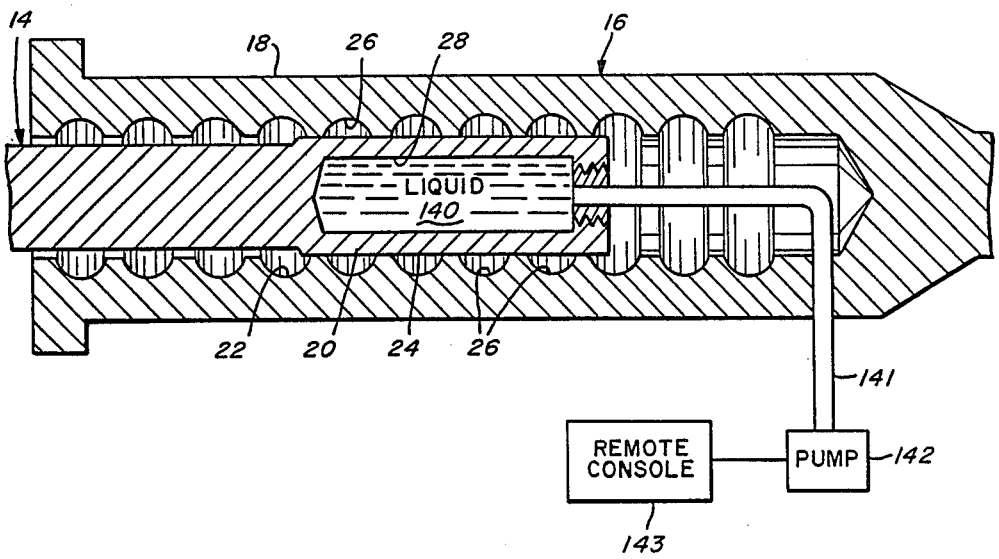

The expansive pressure needed to produce permanent deformation of the wall of the interior chamber 28 may be obtained by (a) disposing a highly explosive substance 28*a* to blast in the chamber 28 with an associated detonator 128 (shown in FIG. 4) and hermetically sealing the chamber 28, and activating an electric discharge from a central console 129 through electrical wiring (see FIG. 4);

(b) starting a chemical reaction among different substances 130, 131 (see FIG. 10) mixed and confined hermetically in the interior chamber 28, with a reaction product in the form of a new solid, liquid or gaseous substance that produces very high pressure within the chamber 28. Such chemical reaction may be initiated with an electrode which produces an electric spark, or by the high temperature of an electric fuse, through electrical wiring connected to a central console; and (c) applying a very high hydraulic pressure to a liquid or fluid 140 (see FIG. 11) confined in the interior chamber 28, through a high pressure piping system 141 connected to pumps 142 and operated from a remote central console 143.

It will of course be apparent that any other physical and/or chemical procedure, adapted to generate extremely high pressure within the interior chamber 28 with or without elevation of temperature may be applied, without departing from the essential concept of the present invention.

Figure 9:
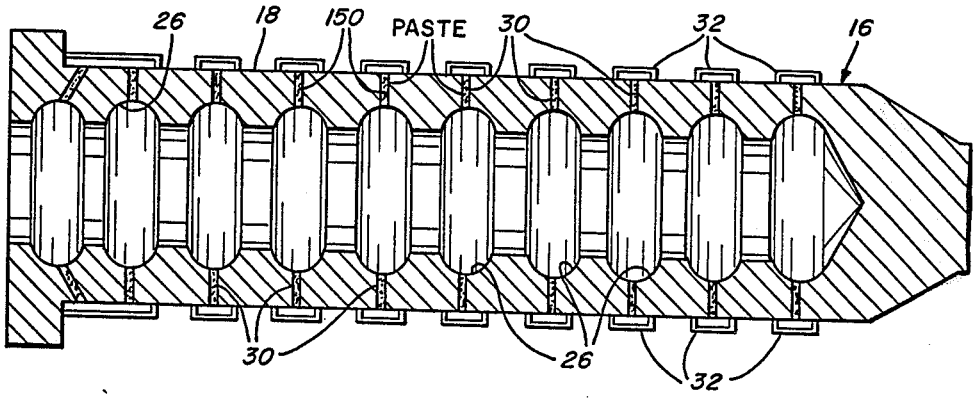
FIG. 9 is a sectional view of a modification to the first embodiment.

To facilitate the deformation of the mating end wall about the chamber 28 when pressurized, and to avoid back-pressure of air, water or any other substance possibly present in the clearance spaces 26 which would otherwise hinder the action of the expansive pressure, drain holes 30 may be provided in the bell-shaped end 18 to communicate between the bases of the clearance spaces 26 and the outside, as shown in FIG. 9. To avoid damage to the joint formed between the mating end 20 and the bell-shaped end 18, the drain holes 30 can be initially obstructed with a soft paste 150 (FIG. 9) sufficient to isolate the clearance spaces 26 and the outside air or water, but unable to stand pressure above a certain magnitude. FIG. 9 shows the paste 150 in only two holes 30, but it may be provided in as many holes 30 as desired. Eventually, the soft paste 150 can serve as an indicator of the extent of the deformation of the mating end wall about the interior chamber 28, since the amount of paste expelled corresponds to the reduction in volume of the clearance spaces 26 adjacent the mating end 20 as the wall expands.

To make the paste within the drain holes 30 more visible while being expelled, and to obtain a better indication of the reduction of clearance space volume, the paste can be impregnated with an insoluble, colored, phosphorescent or reflective tint. Simple mechanical deflectors 32 such as shown in FIG. 9 may be used to force the paste to spread onto the exterior surface of the bell-shaped end 18 to make the paste more easily observable.

Inasmuch as the structural members 10 may be subject to compression stresses during the life of the assembled structure, the first and the second elongate sections 14, 16 should be joined by way of the bell-shaped end 18 and mating end 20 near one of the ends of an overall structural member 10. This will reduce or prevent the effects of buckling.

It may sometimes be necessary to give some of the inter-connecting structural members a remanent tension stress or compression stress to increase the resistance and/or rigidity of a given structure. The present invention enables the application of such a pre-stress or pre-compression to the structural member 10.

To obtain tension or compression stresses, members must be shortened or lengthened by applying temperatures lower or higher with respect to the temperature of the remaining structure, before the final lengths of the members are fixed. By way of electric coils or similar devices, heat is applied to a member to increase its length, prior to the second or expansion step of the invention. After the step is over, the temperature is allowed to cool. The member now tends to a reduction in length, but since both ends are connected to the rest of the structure and the mating end 20 is joined within the bell-shaped end 18, a tension stress develops in the structural member 10 to resist the shrinking tendency with the reduction of temperature. An easy calculation, considering the dialation coefficient and the modulus of elasticity of the material used in fabrication of the member, determines the temperature increase to be given the member to obtain precisely the desired tension stress. The member thus becomes pre-stressed.

When a pre-compression is required in a member, cold is applied to the member by way of jets of liquified gas or other suitable material at hand on the construction site. After the temperature of the member is reduced by a calculated amount, the second step of the invention (expansion) is carried out. Thereafter, the tendency of the joined sections 14, 16 to dialate toward a normal length is opposed by the fixing of both ends of the member 10 to the rest of the structure and by the rigidity of the joint formed between the sections 14, 16.

A compression stress thus develops so that the member becomes pre-compressed.

During erection of a structure using common methods, bad weather or unfavorable oceanographic conditions often cause interruptions of the work. The action of winds, storms, high waves, currents and the like act against the stability of the construction. Before all rigid members are installed and during such unfavorable conditions, it is difficult to maintain the columns plumbed, the angles among different parts precisely at the design values and, moreover, bad climatic or ocean conditions make it difficult or impossible for workers to perform delicate and time-consuming tasks needed to join the different elements of the structure with the required exactitude.

The present invention overcomes the foregoing difficulties.

First, procedures for final attachment of the elements at their defined positions do not require the assistance of workers near the members to be fixed. Such procedures can be initiated from a remote central console, perfectly sheltered to overcome any discomfort due to bad climate or ocean conditions.

Second, the swinging or pendular movements of the structure caused by winds, waves, currents and the like, make different structural elements such as columns sway between one side and the other side of an exact position. Thus, the element assumes the exact position only for a very short time, usually not long enough to perform complicated and delicate operations ordinarily required to fix the position of the element at the exact position.

According to the invention, however, the various parameters that define the position of each member at any instant on the site, such as verticality of a column, horizontality of a beam, value of certain angles and the like, can be easily read and evaluated from a remote console through common devices used in the installation, connected to the console through electrical wiring. The expansion required to fix the first and second sections 14, 16 of a structural member 10 when the member 10 is at a desired length, can be produced by an electric discharge from the central console in a very short time. Thus, it becomes quite easy to fix each member exactly when the corresponding parameters indicate that the member is placed in the position anticipated for the project, within margins of error allowed by the rules of the art. Proceeding successively from one structural member or from a selected set of members to the whole structure, it is possible to have the installation performed completely within the strict limits of the rules of the art and without any interruption, no matter how unfavorable the surrounding conditions may be. This is an important feature of the invention, in that any delay in the completion of the installation of the whole structure represents an elevation of costs.

Although preferred embodiments of the present invention are shown and described herein, with the assumption that the member sections 14, 16 are formed by a single steel shape or pipe, it will be apparent that the fundamental concept of the invention is applicable to structural members formed by two or more structural shapes. In such cases, the use of two or more joints each formed between a bell-shaped end 18 and a mating end 20 will probably be necessary, with interior chambers 28 of each mating end being expanded simultaneously when the structural member is to be fixed in length.

I claim:

1. A structural member comprising a first elongate section having a hollow mating end portion, and a second elongate section adapted to be axially joined to one another, said second section including a hollow generally bell-shaped end portion for slidably receiving therein the hollow mating end portion of said first section, an inner peripheral portion of said bell-shaped end portion having at least one recess therein, said mating end portion defining with an inner periphery of said bell-shaped end portion a clearance space of a certain cross-section, and expanding means associated with said hollow mating end portion of said first section for producing an expansion force in the hollow of said hollow mating end portion for inelastically deforming said hollow mating end portion to an extend exceeding the elastic limit of the material of said hollow mating end portion and without exceeding the elastic limit of said bell-shaped end portion so that the outer periphery of said hollow mating end portion is expanded to fill said clearance space and to press said hollow mating end portion against the inner periphery of said bell-shaped end portion to enter said at least one recess and to remain in at least one recess after removal of said expansion force, to thereby fix said first and second sections to one another at a desired relative axial position.

2. A structural member according to claim 1, wherein the outer periphery of the mating end of said first section is substantially cylindrical.

3. A structural member according to claim 1, wherein the inner periphery of the bell-shaped end portion of said second section forms a series of spaced-apart toroidal cavities co-axial with said second section, said cavities defining said at least one recess and being at least partially filled with peripheral portions of said hollow mating end portion upon expansion thereof.

4. A structural member according to claim 1, wherein the inner periphery of the bell-shaped end portion of said second section forms helicoidal cavity co-axial with said second section, said cavities defining said at least one recess and being at least partially filled with peripheral portions of said hollow mating end portion upon expansion thereof.

5. A structural member according to claim 1, wherein the inner periphery of the bell-shaped end portion of said second section forms a series of cylindrical cavities having axes perpendicular to the axis of said second section said cavities defining said at least one recess and being at least partially filled with peripheral portions of said hollow mating end portion upon expansion thereof.

6. A structural member according to claim 1, wherein the inner periphery of the bell-shaped end portion of said second section forms a series of cylindrical cavities having axes co-axial with said second section said cavities defining said at least one recess and being at least partially filled with peripheral portions of said hollow mating end portion upon expansion thereof.

7. A structural member according to claim 1, wherein said expanding means includes an explosive substance contained in the hollow mating end portion of said first section, and detonator means for detonating said explosive substance.

8. A structural member according to claim 7, wherein said detonator means includes electrode means for applying an electric discharge to said explosive substance, and console means remote from said first section for causing energy to be supplied to said electrode means.

9. A structural member according to claim 1, wherein said expanding means includes different substances which when reacted with one another form a product which tends to increase the pressure within said hollow mating end portion, and means for reacting said different substances.

10. A structural member according to claim 9, wherein said reacting means includes heating means for applying heat energy to said substances, and console means remote from said first section for causing energy to be supplied to said heating means.

11. A structural member according to claim 1, including drain passages communicating said clearance space with the exterior of the bell-shaped end portion of said second section, for venting pressure developed in said clearance space to the exterior when said hollow mating end portion of said first section is expanded against the inner periphery of the bell-shaped end portion and into the clearance space.

12. A structural member according to claim 11, including paste means in said drain passages for initially isolating said clearance space from the exterior of said second section, said paste means being adapted to be expelled from said drain passages in response to said back pressure.

13. A structural member according to claim 12, wherein said paste means includes an insoluble colored tint medium for providing a relative indication of deformation of said mating end into said clearance space as said paste means is expelled from the outer periphery of said bell-shaped end.

14. A structural member according to claim 13, including deflector means on the outer periphery of said bell-shaped end for forcing said paste means to spread over said outer periphery as said paste means is expelled through said drain passages.

15. A method of erecting a structure while allowing for elongation or contraction in the length of at least one structural member, comprising:

arranging at least one structural member of the structure in the form of a first elongate section having a hollow mating end portion and a second elongate section including a hollow generally bell-shaped end portion;

slidably receiving the hollow mating end portion of the first section in the bell-shaped end portion of the second section, thereby defining a clearance space between the outer periphery of said hollow mating end portion and the inner surface of said bell-shaped end portion;

allowing the first and the second sections to slide axially relative to one another at least during erection of the structure; and preventing sliding movement of the hollow mating end portion of the first section within said bell-shaped end portion by generating an expansion force in the hollow of said hollow end portion for expanding said hollow end portion into said clearance space and forcibly against the interior of the bell-shaped end of said second section, the hollow mating end portion being expanded during the expanding step to an extent exceeding the elastic limit of the material of said hollow mating end portion and without exceeding the elastic limit of said bell-shaped end portion so that the outer periphery of said hollow mating end portion is expanded to fill said clearance space and to press said hollow mating end portion against the inner periphery of said bell-shaped end portion to enter said at least one recess and to remain in said at least one recess after removal of said expansion force, thereby fixing the length of said structural member at a desired time after erecting the structure.

16. The method of claim 15, including initiating said preventing stop from a control location remote from the structure.

17. The method of claim 16, including erecting the structure on a sea bed, and said initiating step is carried out after settling of the sea bed.

18. The method of claim 15, including pre-tensioning said at least one structural member by applying heat to an end of one of said first and second elongate sections, prior to initiating said preventing step.

19. The method of claim 15, including pre-compressing said at least one structural member by applying cold to an end of one of said first and said second elongate sections, prior to initiating said preventing step.

* * * * *

UNITED STATES PATENT AND TRADEMARK OFFICE

CERTIFICATE OF CORRECTION

PATENT NO. : 4,867,609

DATED : September 19, 1989

INVENTOR(S) : Isaac GROSMAN

It is certified that error appears in the above-identified patent and that said Letters Patent is hereby corrected as shown below:

Column 8, line 17 (claim 1), "extend" should read --extent--.

Signed and Sealed this

Eleventh Day of September, 1990

*Attest:*

HARRY F. MANBECK, JR.

*Attesting Officer*

*Commissioner of Patents and Trademarks*